US008552947B2

(12) United States Patent
Kim

(10) Patent No.: US 8,552,947 B2
(45) **Date of Patent: *Oct. 8, 2013**

(54) DRIVING DEVICE AND DISPLAY APPARATUS HAVING THE SAME

(75) Inventor: Woo-Chul Kim, Uijeongbu-si (KR)

(73) Assignee: Samsung Display Co., Ltd. (KR)

( * ) Notice: Subject to any disclaimer, the term of this patent is extended or adjusted under 35 U.S.C. 154(b) by 90 days.

This patent is subject to a terminal disclaimer.

(21) Appl. No.: 13/304,143

(22) Filed: Nov. 23, 2011

(65) Prior Publication Data

US 2012/0069061 A1 Mar. 22, 2012

Related U.S. Application Data

(63) Continuation of application No. 11/712,301, filed on Feb. 27, 2007, now Pat. No. 8,085,230.

(30) Foreign Application Priority Data

Apr. 17, 2006 (KR) ..... 10-2006-0034669

(51) Int. Cl.
*G09G 3/36* (2006.01)

(52) U.S. Cl.
USPC ..... 345/89; 345/690

(58) Field of Classification Search
USPC ..... 345/690, 89
See application file for complete search history.

(56) References Cited

U.S. PATENT DOCUMENTS 6,256,010 B1 7/2001 Chen et al.
6,654,028 B1 * 11/2003 Yamakawa ..... 345/690
6,801,220 B2 * 10/2004 Greier et al. ..... 345/694
6,853,384 B2 * 2/2005 Miyata et al. ..... 345/601
6,930,663 B2 * 8/2005 Sekiya et al. ..... 345/87
7,733,314 B2 6/2010 Cho
7,990,401 B2 * 8/2011 Li et al. ..... 345/690
2002/0024481 A1 * 2/2002 Kawabe et al. ..... 345/87
2002/0033789 A1 * 3/2002 Miyata et al. ..... 345/89
2002/0050971 A1 * 5/2002 Su et al. ..... 345/92
2002/0135604 A1 9/2002 Yoneyama
2002/0149598 A1 * 10/2002 Greier et al. ..... 345/589
2003/0006952 A1 * 1/2003 Hong ..... 345/89
2003/0025664 A1 * 2/2003 Koga et al. ..... 345/89
2003/0080931 A1 5/2003 Chen et al.
2003/0222840 A1 * 12/2003 Koga et al. ..... 345/89
2003/0227429 A1 12/2003 Shimoshikiryo
2004/0125064 A1 7/2004 Adachi et al.
2004/0130559 A1 * 7/2004 Lee et al. ..... 345/690

(Continued)

FOREIGN PATENT DOCUMENTS

CN 1694152 A 11/2005
JP 2005-107491 4/2005

(Continued)

*Primary Examiner* — Dorothy Harris
(74) *Attorney, Agent, or Firm* — Innovation Counsel LLP

(57) ABSTRACT

In a driving device and a display apparatus having the driving device, a converter converts input image data and outputs first and second sub-image data which have different values. A first compensator compensates the first sub-image data and outputs a first compensated image data, and a second compensator compensates the second sub-image data and outputs a second compensated image data. An output circuit controls output time of the first and second compensated image data. Accordingly, sub-image data for each sub-pixel may be exactly compensated by employing compensators to individually compensate for the sub-image data of each sub-pixel.

21 Claims, 6 Drawing Sheets

(56) References Cited

U.S. PATENT DOCUMENTS

| | | | | |
|---|---|---|---|---|
| 2004/0174389 | A1 | 9/2004 | Ben-David et al. | |
| 2004/0196274 | A1* | 10/2004 | Song et al. | 345/204 |
| 2004/0207625 | A1 | 10/2004 | Griffin et al. | |
| 2005/0052389 | A1* | 3/2005 | Sawabe | 345/89 |
| 2005/0062702 | A1 | 3/2005 | Lee et al. | |
| 2005/0093803 | A1 | 5/2005 | Cheon et al. | |
| 2005/0122441 | A1 | 6/2005 | Shimoshikiryoh | |
| 2005/0225522 | A1* | 10/2005 | Wu et al. | 345/87 |
| 2005/0225525 | A1* | 10/2005 | Wu et al. | 345/89 |
| 2005/0253797 | A1* | 11/2005 | Kamada et al. | 345/89 |
| 2005/0270262 | A1* | 12/2005 | Oh | 345/89 |
| 2006/0007091 | A1* | 1/2006 | Yang et al. | 345/89 |
| 2006/0071927 | A1* | 4/2006 | Chang et al. | 345/211 |
| 2006/0072044 | A1* | 4/2006 | Kawamura et al. | 348/797 |
| 2006/0145981 | A1* | 7/2006 | Lee et al. | 345/89 |
| 2007/0052640 | A1* | 3/2007 | Feldman | 345/88 |
| 2008/0143657 | A1 | 6/2008 | Weiss et al. | |
| 2008/0238910 | A1 | 10/2008 | Klompenhouwer et al. | |

FOREIGN PATENT DOCUMENTS

| | | | |
|---|---|---|---|
| JP | 2005-316211 | | 11/2005 |
| KR | 10-2004-0053640 | | 6/2004 |
| KR | 10-2006-0012801 | | 2/2006 |
| WO | 2005096263 | A2 | 10/2005 |
| WO | 2006025021 | A1 | 3/2006 |

* cited by examiner

DRIVING DEVICE AND DISPLAY APPARATUS HAVING THE SAME

CROSS-REFERENCE TO RELATED APPLICATIONS

This application is a continuation application of U.S. patent application Ser. No. 11/712,301 filed on Feb. 27, 2007, which claims priority to and the benefit of Korean Patent Application No. 10-2006-0034669 filed in the Korean Intellectual Property Office on Apr. 17, 2006, the entire contents of the prior applications being incorporated herein by reference.

FIELD OF THE INVENTION

The present invention relates to a driving device and a display apparatus having the driving device. More particularly, the present invention relates to a driving device capable of individually compensating for sub-image data of each sub-pixel and a display apparatus having the driving device.

DESCRIPTION OF THE RELATED ART

In general, liquid crystal display (LCD) devices have a narrower viewing angle than cathode ray tube devices. In order to improve the narrow viewing angle of the LCD devices, patterned vertical alignment (PVA) LCD devices, multi-domain vertical alignment (MVA) LCD devices, and super-patterned vertical alignment (S-PVA) LCD devices having wide viewing angle characteristics have been recently developed. Essentially, the S-PVA LCD device includes a pixel having two sub-pixels. The two sub-pixels include main and sub-pixel electrodes to which different voltages are applied in order to form domains having different gray scales. Since a user looking at the LCD device recognize an intermediate value of two sub-voltages, narrowing of the lateral viewing angle due to gamma curve distortion at an intermediate gray scale or less is prevented. Accordingly, the lateral viewing angle of the LCD device is widened.

Recently, a dynamic capacitance compensation (DCC) method is used with the S-PVA LCD device in order to obtain a higher liquid crystal response speed. The faster response of the liquid crystals is obtained by applying a compensated gray scale to the present frame by taking a target gray scale of the present frame and a gray scale of a previous frame into consideration.

The conventional S-PVA LCD device compensates the input gray scale before dividing the input gray scale into two sub-gray scales to create a compensated gray scale, and then creates two sub-gray scales based on the compensated gray scale. However, if the S-PVA LCD device creates the two sub-gray scales based on the compensated gray scale of the input gray scale as described above, the optimal compensated gray scale is not applied to each sub-pixel.

SUMMARY OF THE INVENTION

According to one aspect of the present invention a display device includes a driving device capable of individually compensating for sub-image data of each sub-pixel. The driving device includes a converter, a first compensator, a second compensator, and an output circuit. The converter receives input image data from an external source and outputs first sub-image data having a gray scale higher than the gray scale of the input image data and second sub-image data having a gray scale lower than the gray scale of the input image data. The first compensator compensates for the first sub-image data to output first compensated image data. The second compensator compensates for the second sub-image data to output second compensated image data. The output circuit controls the output time of the first and second compensated image data.

In another aspect of the present invention, the display apparatus includes a timing controller, a gamma reference voltage generator, a data driver, a gate driver, and a display unit. The timing controller receives input image data from an external source and sequentially outputs first and second compensated image data. The gamma reference voltage generator outputs a gamma reference voltage. Based on the gamma reference voltage, the data driver converts first compensated image data to output a first data voltage during a first period and converts second compensated image data to output a second data voltage during a second period. The gate driver outputs a first gate signal during the first period and a second gate signal during the second period. The display unit includes a plurality of pixels having a first pixel receiving the first gate signal and the first data voltage and a second pixel receiving the second gate signal and the second data voltage to display an image. The timing controller includes a converter, a first compensator, a second compensator, and an output circuit. The converter receives the input image data and converts the input image data to output first sub-image data and second sub-image data, wherein the first sub-image data has a gray scale higher than a gray scale of the input image data, and the second sub-image data has a gray scale lower than the gray scale of the input image data. The first compensator compensates for the first sub-image data to output the first compensated image data. The second compensator compensates for the second sub-image data to output the second compensated image data. The output circuit controls output time of the first and second compensated image data.

According to the above, the driving device for the display apparatus converts input image data into first and second sub-image data and then individually compensates for the first and second sub-image data to generate first and second compensated image data, thereby providing the optimal compensated image data to each sub-pixel.

BRIEF DESCRIPTION OF THE DRAWING

The above and other advantages of the present invention will become readily apparent by reference to the following detailed description when considered in conjunction with the accompanying drawing, in which.

DESCRIPTION OF THE EMBODIMENTS

Figure 1:
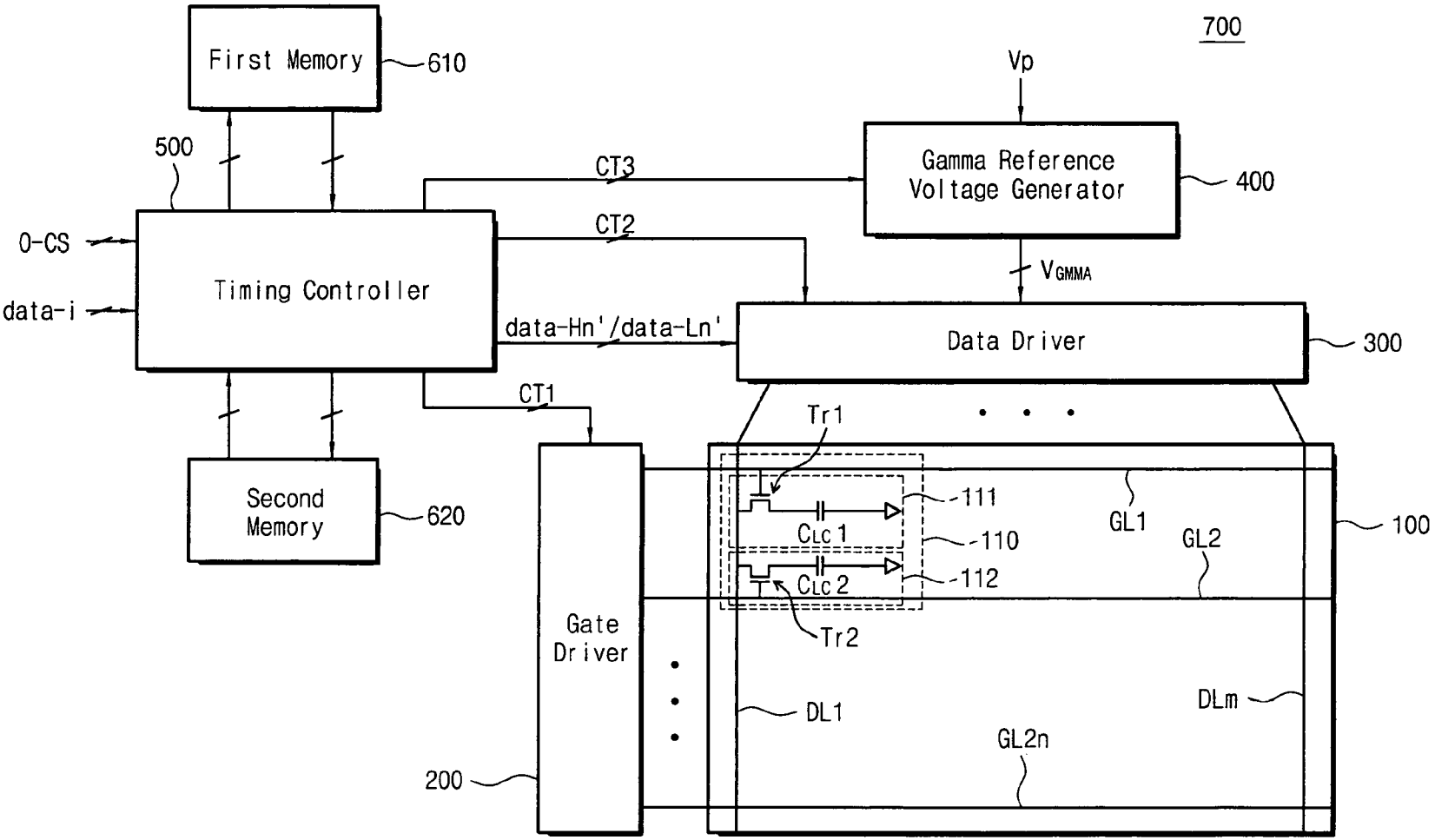
FIG. 1 is a block diagram showing an exemplary embodiment of an LCD device according to the present invention.
Figure 2:
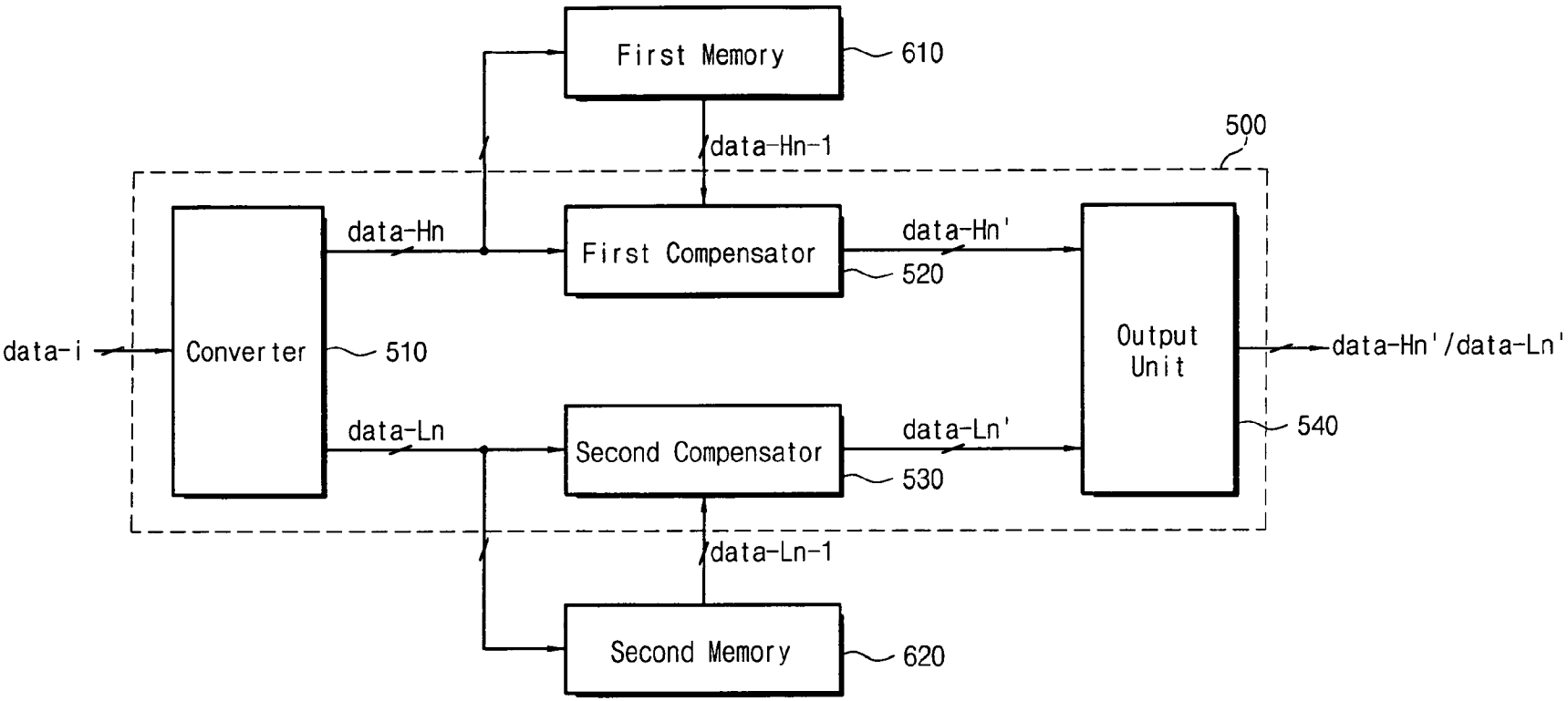
FIG. 2 is a block diagram showing an internal structure of a timing controller of FIG. 1.

FIG. 1 is a block diagram of an LCD device 700 according to an exemplary embodiment of the present invention, and FIG. 2 is a block diagram illustrating an internal structure of a timing controller shown in FIG. 1. Referring to FIG. 1, the LCD device 700 includes a display unit 100, a gate driver 200, a data driver 300, a gamma reference voltage generator 400, and a timing controller 500.

The display unit 100 is provided with a plurality of gate lines GL1 to GL2*n* receiving the gate voltage and a plurality of data lines DL1 to DLm receiving the data voltage. Gate lines GL1 to GL2*n* and data lines DL1 to DLm are aligned on the display unit 100 in a matrix pattern defining a plurality of pixel areas where each of pixels 110 includes a first sub-pixel 111 and a second sub-pixel 112. The first sub-pixel 111 includes a first thin film transistor Tr1 and a first liquid crystal capacitor $C_{LC1}$, and the second sub-pixel 112 includes a second thin film transistor Tr2 and a second liquid crystal capacitor $C_{LC2}$.

Gate driver 200 is electrically connected to gate lines GL1 to GL2*n* provided to apply gate signals to the gate lines. Data driver 300 is electrically connected to data lines DL1 to DLm to apply first and second data voltages to the data lines. The first data voltage has a voltage level higher than the second data voltage. According to an exemplary embodiment, a driving circuit of a gate driver (not shown) is formed on the substrate corresponding to a peripheral area thereof and is adjacent to an end of the gate lines.

The driving circuit of the gate driver is electrically connected to the end of the gate lines GL1 to GL2*n* to apply gate signals to the gate lines. The driving circuit of the gate driver includes a shift register (not shown) having a plurality of stages. Each of the stages (not shown) includes an S-R latch and an AND-gate.

Timing controller 500 receives input image signals R, G and B and various control signals O-CSs from an external graphic controller (not shown). Timing controller 500 compensates input image data data-i by outputting first compensated image data data-Hn', or second compensated image data data-Ln'. In addition, the timing controller 500 receives various control signals O-CS, such as vertical synchronous signals, horizontal synchronous signals, main clock signals, data enable signals, etc., in order to output first, second and third control signals CT1, CT2 and CT3.

The first control signal CT1 is applied to gate driver 200 to control the operation of gate driver 200. The first control signal CT1 includes a vertical start signal used to initiate the operation of gate driver 200, a gate clock signal used to determine an output time of the gate voltage, and an output enable signal used to determine the on-pulse width of the gate voltage.

Gate driver 200 sequentially outputs the gate signals to gate lines GL1 to GL2*n* in response to the first control signal CT1 from the timing controller 500.

The second control signal CT2 is applied to data driver 300 to control the operation of data driver 300. The second control signal CT2 includes a horizontal start signal used to initiate the operation of data driver 300, a reversal signal used to reverse polarity of the data voltage, and an output command signal used to determine an output time of the first and second voltages from data driver 300.

Data driver 300 sequentially receives the first compensated image data data-Hn' or the second compensated image data data-Ln', which correspond to pixels of each one row, in response to the second control signal CT2 from the timing controller 500.

Meanwhile, gamma reference voltage generator 400 receives a power supply voltage Vp and generates the gamma reference voltage $V_{GMMA}$ in response to the third control signal CT3 from timing controller 500. Data driver 300 converts the first compensated image data data-Hn' into the first data voltage based on the gamma reference voltage $V_{GMMA}$ and outputs the first data voltage to data lines DL1 to DLm in the first period during which the first sub-pixel 111 is driven. In addition, data driver 300 converts the second compensated image data data-Ln' into the second data voltage based on the gamma reference voltage $V_{GMMA}$ and outputs the second data voltage to data lines DL1 to DLm in the second period during which the second sub-pixel 112 is driven.

As shown in FIG. 2, timing controller 500 includes a converter 510, a first compensator 520, a second compensator 530, and an output unit 540.

Converter 510 receives the input image data data-i and outputs first and second sub-image data data-Hn and data-Ln having mutually different values. In detail, the first sub-image data data-Hn has a gray scale value higher than that of the second sub-image data data-Ln.

The first sub-image data data-Hn are provided to the first compensator 520 and the first memory 610, and the second sub-image data data-Ln are provided to the second compensator 530 and the second memory 620. Sub-image data data-Hn−1 of a previous frame have been previously stored in the first memory 610, and sub-image data data-Ln−1 of the previous frame have been previously stored in the second memory 620.

In a present frame, if the first and second previous sub-image data data-Hn−1 and data-Ln−1 are read out from the first and second memories 610 and 620 by timing controller 500, the first and second sub-image data data-Hn and data-Ln are stored in the first and second memories 610 and 620, respectively. Accordingly, the first and second sub-image data data-Hn and data-Ln corresponding to one frame are sequentially stored in the first and second memories 610 and 620.

The first compensator 520 compensates for the first sub-image data data-Hn from the converter 510 based on the first previous sub-image data data-Hn−1 read out from the first memory 610, thereby outputting the first compensated image data data-Hn'. In detail, if the differential value between the first previous sub-image data data-Hn−1 and the first sub-image data data-Hn is greater than a preset first reference value, the first compensator 520 creates the first compensated image data data-Hn' by adding a preset first compensation value $\alpha$1 to the first sub-image data data-Hn. Meanwhile, if the differential value between the first previous sub-image data data-Hn−1 and the first sub-image data data-Hn is equal to or less than a preset first reference value, the first compensator 520 generates the first compensated image data data-Hn' identical to the first sub-image data data-Hn.

The second compensator 530 compensates for the second sub-image data data-Ln from the converter 510 based on the second previous sub-image data data-Ln−1 read out from the second memory 620, thereby outputting the second compensated image data data-Ln'. In detail, if a differential value between the second previous sub-image data data-Ln−1 and the second sub-image data data-Ln is greater than a preset second reference value, the second compensator 530 creates the second compensated image data data-Ln' by adding a preset second compensation value $\alpha$2 to the second sub-image data data-Ln. Meanwhile, if the differential value between the second previous sub-image data data-Ln−1 and the second sub-image data data-Ln is equal to or less than a preset second reference value, the second compensator 530 generates the second compensated image data data-Ln' substantially identical to the second sub-image data data-Ln.

Output unit 540 receives the first and second compensated image data data-Hn' and data-Ln' from the first and second compensators 520 and 530, respectively. The output unit 540 outputs the first compensated image data data-Hn' in the first period during which the first sub-pixels are driven, and outputs the second compensated image data data-Ln' in the second period during which the second sub-pixels are driven.

Figure 3:
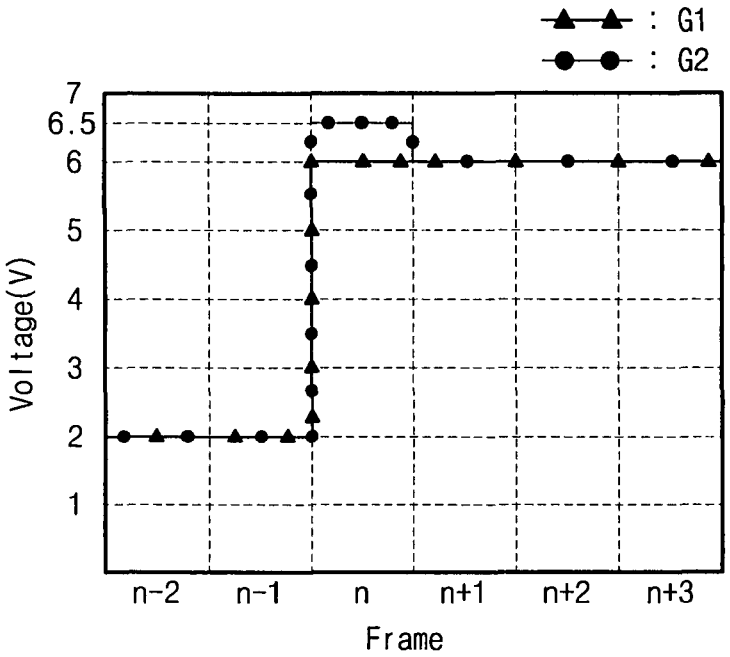
FIG. 3 is a graph showing an input/output signal of a first compensator shown in FIG. 2.
Figure 4:
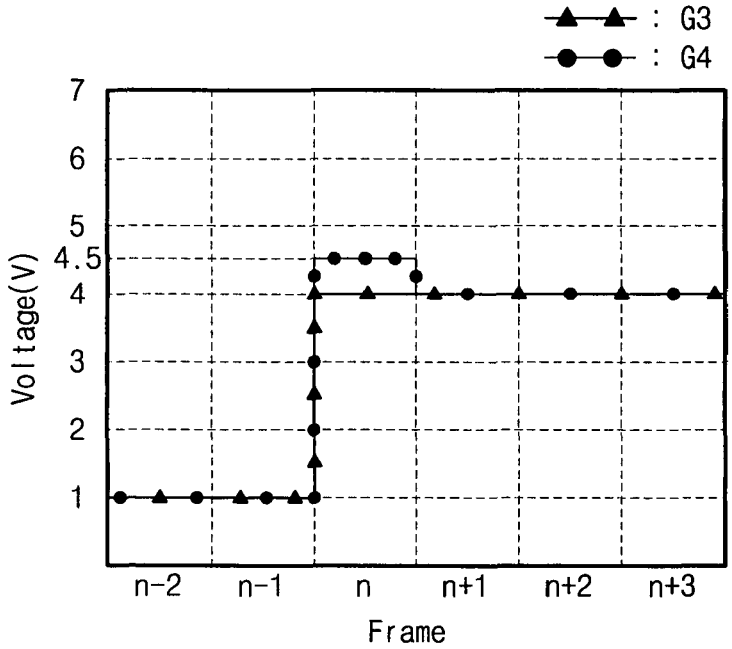
FIG. 4 is a graph showing an input/output signal of a second compensator shown in FIG. 2.

FIG. 3 is a graph showing an input/output signal of the first compensator 520 of FIG. 2. FIG. 4 is a graph showing an input/output signal of the second compensator 530 of FIG. 2. In FIGS. 3 and 4, x and y axes represent frames and voltages (V), respectively.

A first graph G1 shown in FIG. 3 represents an input signal input into the first compensator 520 (see, FIG. 2), and the second graph G2 represents an output signal from the first compensator 520. A third graph G3 shown in FIG. 4 represents an input signal input into the second compensator 530 (see, FIG. 2), and a fourth graph G4 represents an output signal from the second compensator 530.

As shown in the first graph G1 of FIG. 3, the input signal maintains the voltage level of 2V during $(n-2)^{th}$ and $(n-1)^{th}$ frames and the voltage level of 6V during $n^{th}$ to $(n+3)^{th}$ frames. Herein, the voltage (V) is expressed as an absolute value.

As shown in the second graph G2, since the differential value (4V) between the first sub-image data data-Hn of the $n^{th}$ frame and the first previous sub-image data data-Hn−1 of the $(n-1)^{th}$ frame is greater than a first preset reference value (e.g., 3V), the first compensator 520 outputs the first compensated image data data-Hn' obtained by increasing the first sub-image data data-Hn by a first compensation value (e.g., 0.5V) during the $n^{th}$ frame.

In addition, as shown in the third graph G3 of FIG. 4, the input signal maintains the voltage level of 1V during the $(n-2)^{th}$ and $(n-1)^{th}$ frames and the voltage level of 4V during the $n^{th}$ to $(n+3)^{th}$ frames. Herein, the voltage (V) is expressed as an absolute value.

As shown in the fourth graph G4, since the differential value 3V between the second sub-image data data-Ln of the $n^{th}$ frame and the second previous sub-image data data-Ln−1 of the $(n-1)^{th}$ frame is greater than the second preset reference value (e.g., 2V), the second compensator 530 outputs the second compensated data data-Ln' obtained by increasing the second sub-image data data-Ln by the second compensation value (e.g., 0.5V) during the $n^{th}$ frame.

As shown in FIGS. 1 to 4, the input image data data-i are converted into the first and second sub-image data data-Hn and data-Ln, and then the first and second sub-image data data-Hn and data-Ln are compensated into the first and second compensated image data data-Hn' and data-Ln', respectively. Accordingly, the optimal first and second compensated image data data-Hn' and data-Ln' can be provided to the first and second sub-pixels, respectively.

Figure 5:
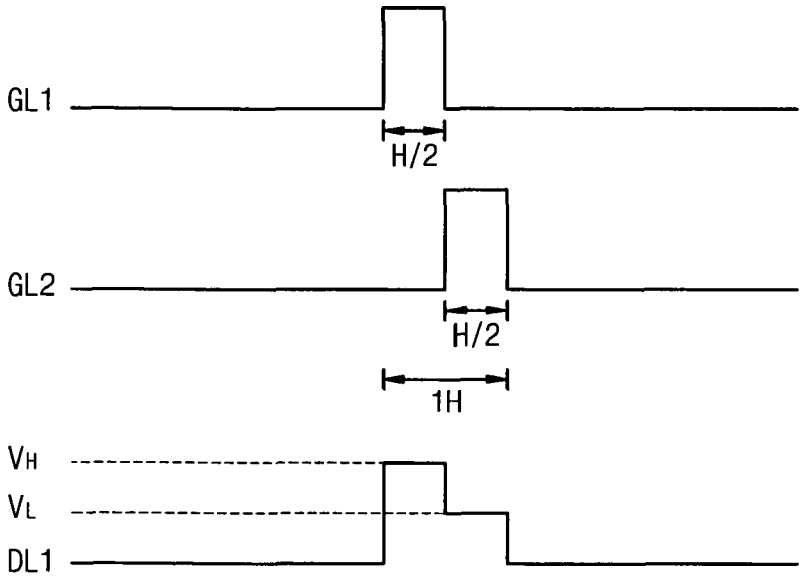
FIG. 5 is a waveform diagram of signals applied to first and second gate lines and a first data line shown in FIG. 1.

FIG. 5 is a waveform diagram of signals applied to the first and second gate lines and the first data line shown in FIG. 1.

Referring to FIG. 5, a first gate signal, which maintains a high state for an earlier H/2 period of 1H, is applied to the first gate line GL1, wherein one pixel is driven during 1H and the first sub-pixel is driven during the earlier H/2 period. In addition, a second gate signal, which maintains a high state for a later H/2 period of 1H, is applied to the second gate line GL2, wherein one pixel is driven during 1H and the second sub-pixel is driven during the later H/2 period.

The first TFT Tr1 outputs a first data voltage $V_H$ applied to the first data line DL1 in response to the first gate signal. Then, the second TFT Tr2 outputs a second data voltage $V_L$ that has a voltage level lower than that of the first data voltage $V_H$ and is applied to the first data line DL1 in response to the second gate signal. Accordingly, the first liquid crystal capacitor $C_{LC1}$ is charged with the first data voltage $V_H$, and the second liquid crystal capacitor $C_{LC2}$ is charged with the second data voltage $V_L$.

Figure 6:
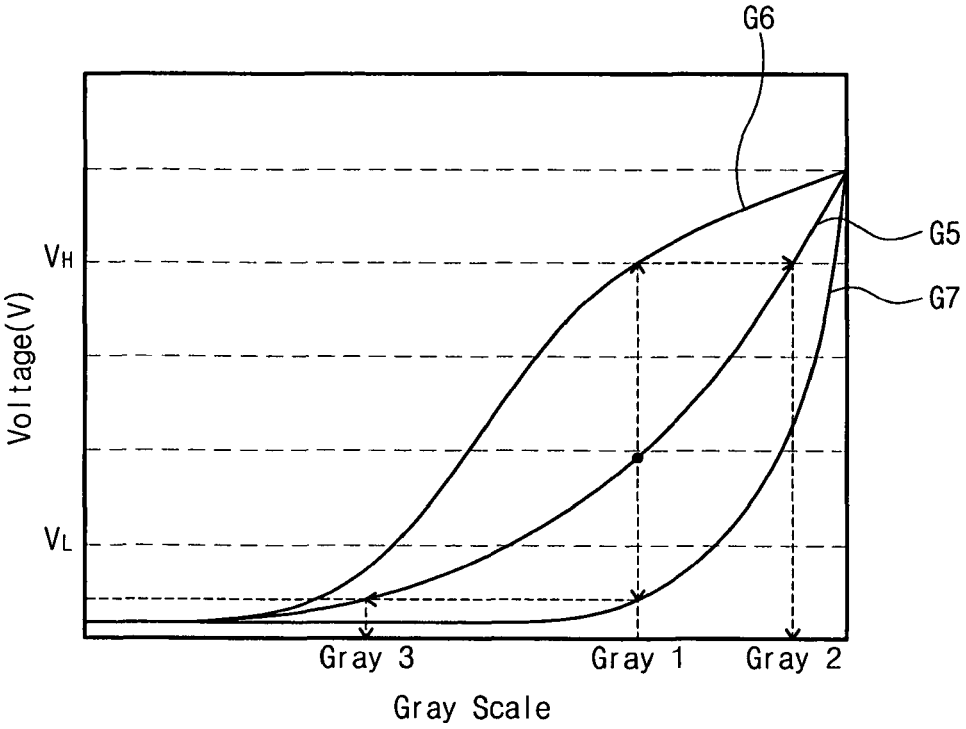
FIG. 6 is a graph showing voltages of first and second sub-pixels according to gray scales.

FIG. 6 is a graph showing voltages of the first and second sub-pixels according to gray scales. In FIG. 6, x and y axes represent a gray scale and a voltage (V), respectively. Additionally, fifth, sixth, and seventh graphs G5, G6, and G7 represent a first gamma curve of the input image data data-i (see, FIG. 2), a second gamma curve of the first sub-image data data-Hn (see, FIG. 2), and a third gamma curve of the second sub-image data data-Ln (see, FIG. 2) in FIG. 6, respectively.

As shown in FIG. 6, the first to third gamma curves have voltage levels that become higher in the order of the second, first, and third gamma curves at the same gray scale (for example, a first gray scale GRAY 1).

Herein, a gray scale of the first sub-image data data-Hn is converted into a second gray scale GRAY 2 of the first gamma curve corresponding to the first data voltage $V_H$ of the second gamma curve represented at the first gray scale GRAY 1 of the input image data data-i. In addition, a gray scale of the second sub-image data data-Ln is converted into a third gray scale GRAY 3 of the first gamma curve corresponding to the second data voltage $V_L$ of the third gamma curve represented at the first gray scale GRAY 1 of the input image data data-i.

Accordingly, if the first and second data voltages $V_H$ and $V_L$ are applied to the first and second sub-pixels, respectively, the first and second sub-pixels represent brightness different from each other. That is, the brightness of the first sub-pixel is higher than the brightness of the second sub-pixel at the same gray scale. In this case, eyes of a user looking at a liquid crystal panel recognize the intermediate value of the first and second data voltages $V_H$ and $V_L$. Accordingly, narrowing of a lateral viewing angle of the liquid crystal panel due to the distortion of a gamma curve at an intermediate gray scale or less can be prevented.

Figure 7:
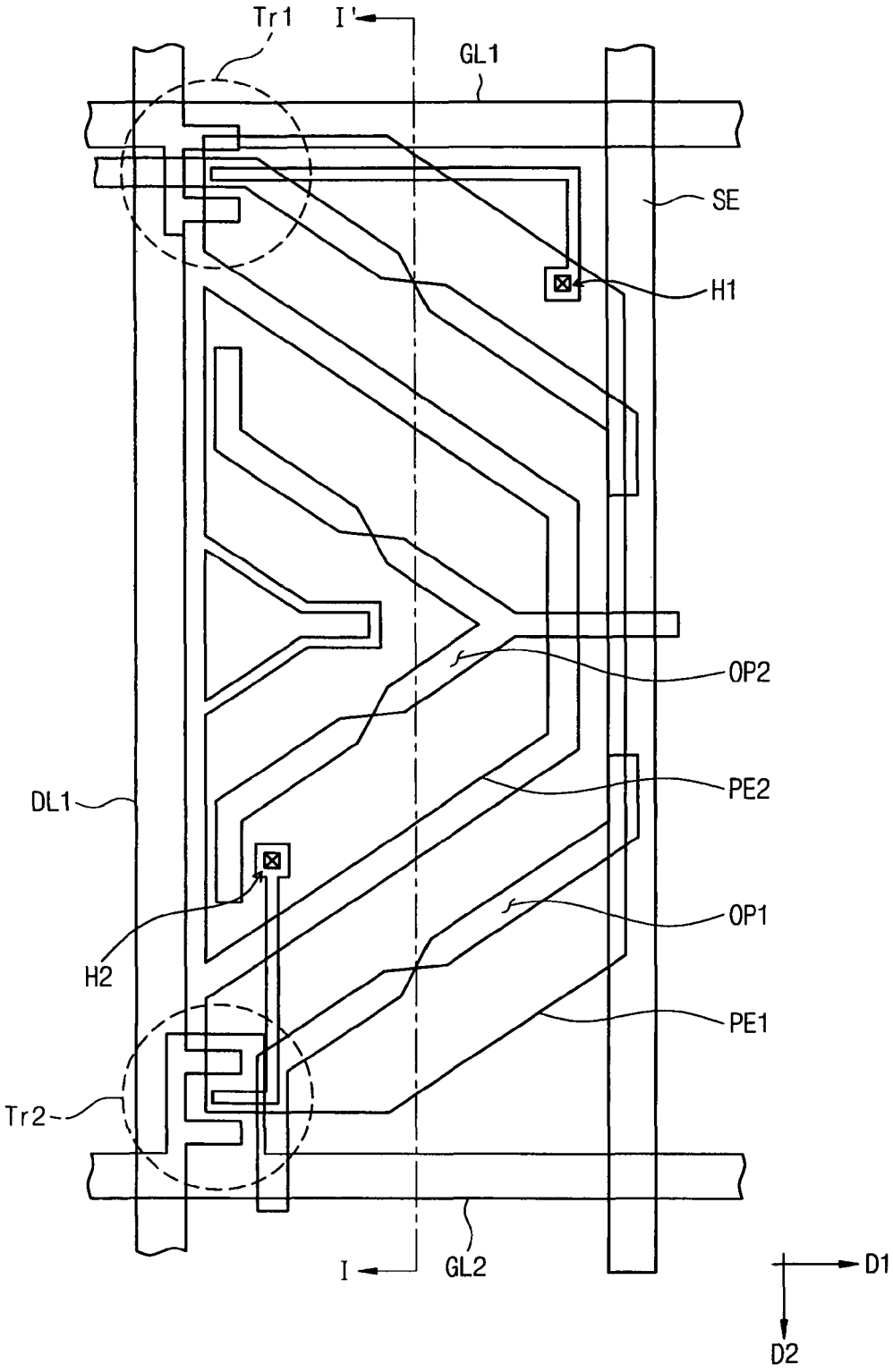
FIG. 7 is a layout view showing one pixel in a display unit shown in FIG. 1.
Figure 8:
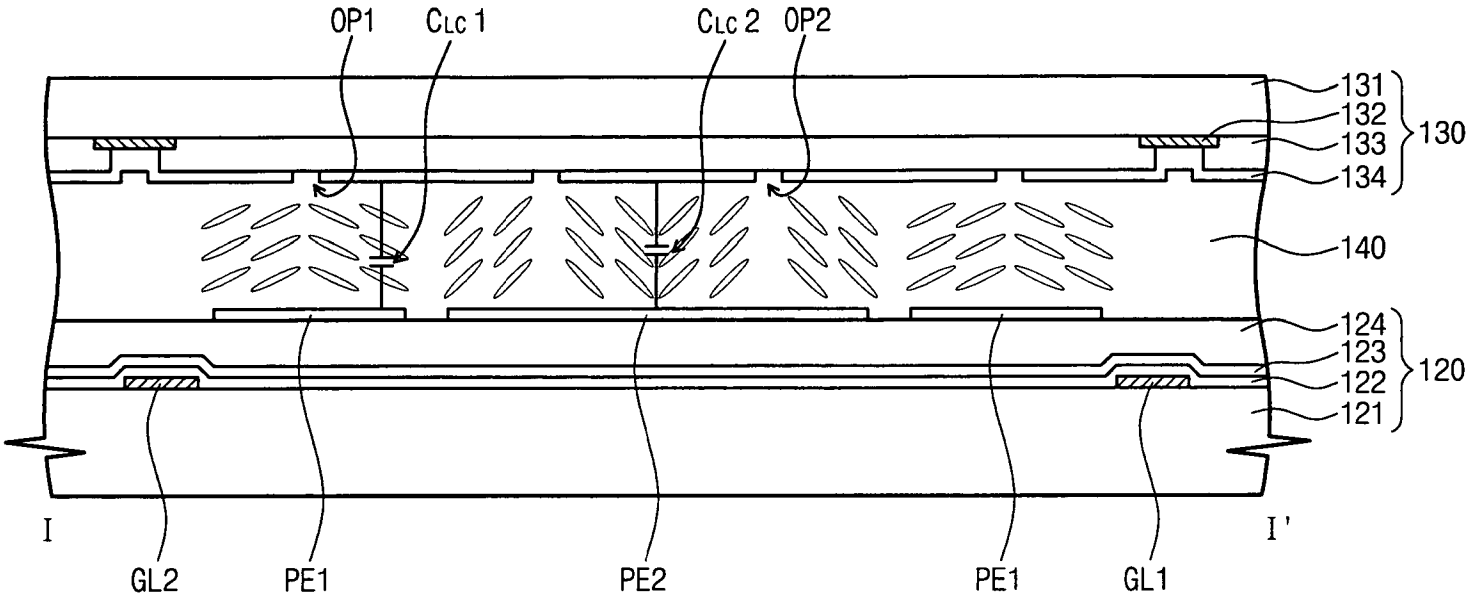
FIG. 8 is a cross-sectional view taken along a line I-I' shown in FIG. 7.

FIG. 7 is a layout view showing one pixel in the display unit 100 shown in FIG. 1, and FIG. 8 is a cross-sectional view taken along a line I-I' shown in FIG. 7.

Referring to FIGS. 7 and 8, the display unit 100 (see, FIG. 1) is prepared in the form of a liquid crystal display panel including an array substrate 120, a color filter substrate 130 facing the array substrate 120, and a liquid crystal layer 140 interposed between the array substrate 120 and the color filter substrate 130 so as to display an image.

Pixel areas are defined on a first base substrate 121 of the array substrate 120 by first and second gate lines GL1 and GL2 extending in a first direction D1 and first data line DL1 extending in the second direction D1 substantially perpendicular to a first direction D1. Pixels including first and second pixels are formed in the pixel areas. In particular, in the array substrate 120, the first pixel includes a first thin film transistor Tr1 and a first pixel electrode PE1, which is an electrode of a first liquid crystal capacitor $C_{LC1}$, and the second pixel includes the second thin film transistor Tr2 and a second pixel electrode PE2, which is an electrode of a second liquid crystal capacitor $C_{LC2}$.

A gate electrode of the first thin film transistor Tr1 is branched from the first gate line GL1, and a gate electrode of the second thin film transistor Tr2 is branched from the second gate line GL2. Source electrodes of the first and second thin film transistors Tr1 and Tr2 are branched from the first data line DL1. A drain electrode of the first thin film transistor Tr1 is connected to the first pixel electrode PE1 through a first contact hole H1, and a drain electrode of the second thin film transistor Tr2 is electrically connected to the second pixel electrode PE2 through a second contact hole H2.

The array substrate 120 further includes a storage electrode SE. The storage electrode SE partially overlaps the second pixel electrode PE2.

As shown in FIG. 8, the array substrate 120 includes a first base substrate 121, the first and second gate lines GL1 and GL2 and further includes a gate insulating layer 122, a protective layer 123, and an organic insulating layer 124 which are provided below the first and second pixel electrodes PE1 and PE2.

Meanwhile, the color filter substrate 130 includes a second base substrate 131 formed with a black matrix 132, a color filter layer 133 and a common electrode 134. The black matrix 132 is formed on a non-effective display area in order to prevent leakage of the light. The color filter layer 133 includes red, green and blue color pixels to allow the light that has passed through the liquid crystal layer 140 to have predetermined color brightness.

The common electrode 134 is formed on the color filter layer 133 as an electrode of the first and second liquid crystal capacitors $C_{LC1}$ and $C_{LC2}$. A predetermined portion of the common electrode 134, which corresponds to center portions of the first and second pixel electrodes PE1 and PE2, is partially removed. Therefore, a first opening OP1 is formed corresponding to the center portion of the first pixel electrode PE1, and a second opening OP2 is formed corresponding to the center portion of the second pixel electrode PE2. As a result, eight domains are formed in the pixel areas in such a manner that liquid crystal molecules included in the liquid crystal layer 140 can be aligned in different directions.

As described above, in the driving device and the display apparatus having the driving device, input image data are converted into first and second sub-image data, and then the first and second sub-image data are compensated into first and second compensated image data by the first and second compensators, respectively.

Accordingly, since the first and second sub-image data can be individually compensated, the optimal compensated image data can be provided to the first and second sub-pixels.

Although the exemplary embodiments of the present invention have been described, it is understood that the present invention should not be limited to these exemplary embodiments but various changes and modifications can be made by one ordinary skilled in the art within the spirit and scope of the present invention.

The claims in this application are different from those of the application(s) from which priority is claimed. Applicant rescinds any disclaimer of claim scope made in the related application(s) and requests that any previous disclaimer and previously cited references be revisited. Further, any disclaimer made in the instant application is not intended to be read into the predecessor application(s).

What is claimed is:

1. A driving device for driving a liquid crystal display device, the liquid crystal display device including a pixel that includes a first sub-pixel and a second sub-pixel, the driving device comprising:

a converter converting input image data for the pixel into first sub-image data for the first sub-pixel and second sub-image data for the second sub-pixel;

a memory unit coupled to the converter and comprising:

a first data memory storing first present sub-image data, which is first sub-image data of a present frame, and outputting first previous sub-image data, which is first sub-image data of a previous frame; and a second data memory storing second present sub-image data, which is second sub-image data of a present frame, and outputting second previous sub-image data, which is second sub-image data of a previous frame;

a compensator unit coupled to the memory unit and compensating the first and second present sub-image data based on the first and second previous sub-image data and the first and second present sub-image data to generate first and second compensated sub-image data, the compensator unit comprising:

a first compensator part compares a first reference value with a differential value between the first sub-image data and the first previous sub-image data and outputs the first compensated sub-image data based on a result of the comparison, and a second compensator part compares a second reference value with a differential value between the second sub-image data and the second previous sub-image data and outputs the second compensated sub-image data based on a result of the comparison; and an output circuit that controls at least one of an output time of the first compensated sub-image data and an output time of the second compensated sub-image data, wherein the first reference value is different from the second reference value.

2. The driving device of claim 1, wherein the first sub-image data generated for the first sub-pixel has a first gray scale, and the second sub-image data generated for the second sub-pixel has a second gray scale that is different from the first gray scale.

3. The driving device of claim 2, wherein the first compensated sub-image data has a first gray scale, and the second compensated sub-image data has a second gray scale that is different from the first gray scale.

4. The driving device of claim 3, wherein the first gray scale is higher than the second gray scale.

5. The driving device of claim 2, wherein the first gray scale is higher than the second gray scale.

6. The driving device of claim 1, wherein the first compensated sub-image data has a first gray scale, and the second compensated sub-image data has a second gray scale that is different from the first gray scale.

7. The driving device of claim 6, wherein the first gray scale is higher than the second gray scale.

8. The driving device of claim 1, wherein the first reference value is higher than the second reference value.

9. A liquid crystal display device displaying an image, the liquid crystal display device comprising:

a display panel including a pixel, the pixel including a first sub-pixel and a second sub-pixel; and a driving device for driving the display panel;

the driving device comprising:

a converter converting input image data for the pixel into first sub-image data for the first sub-pixel and second sub-image data for the second sub-pixel;

a memory unit coupled to the converter and comprising:

a first data memory storing first present sub-image data, which is first sub-image data of a present frame, and outputting first previous sub-image data, which is first sub-image data of a previous frame; and a second data memory storing second present sub-image data, which is second sub-image data of a present frame, and outputting second previous sub-image data, which is second sub-image data of a previous frame;

a compensator unit coupled to the memory unit and compensating the first and second present sub-image data based on the first and second previous sub-image data and the first and second present sub-image data to generate first and second compensated sub-image data, the compensator unit comprising:

a first compensator part compares a first reference value with a differential value between the first sub-image data and the first previous sub-image data and outputs the first compensated sub-image data based on a result of the comparison, and a second compensator part compares a second reference value with a differential value between the second sub-image data and the second previous sub-image data and outputs the second compensated sub-image data based on a result of the comparison; and an output circuit that controls at least one of an output time of the first compensated sub-image data and an output time of the second compensated sub-image data, wherein the first reference value is higher than the second reference value.

10. The liquid crystal display device of claim 9, wherein the first sub-image data generated for the first sub-pixel has a first gray scale, and the second sub-image data generated for the second sub-pixel has a second gray scale that is different from the first gray scale.

11. The display device of claim 10, wherein the first compensated sub-image data has a first gray scale, and the second compensated sub-image data has a second gray scale that is different from the first gray scale.

12. The liquid crystal display device of claim 9, wherein the first compensated sub-image data has a first gray scale, and the second compensated sub-image data has a second gray scale that is different from the first gray scale.

13. The liquid crystal display device of claim 9, further comprising a data driver providing a first data voltage generated based on the first compensated sub-image data to the first sub-pixel, and providing a second data voltage generated based on the second compensated sub-image data to the second sub-pixel.

14. The liquid crystal display device of claim 13, wherein the first data voltage is different from the second data voltage.

15. The liquid crystal display device of claim 13, wherein a gamma curve of the first sub-pixel is different from a gamma curve of the second sub-pixel.

16. A method for driving a liquid crystal display device, the liquid crystal display device including a pixel, the pixel including a first sub-pixel and a second sub-pixel, the method comprising:

converting previous input image data for the pixel into first previous sub-image data for the first sub-pixel and second previous sub-image data for the second sub-pixel in a previous frame;

converting present input image data for the pixel into first present sub-image data for the first-sub pixel and second present sub-image data for the second sub-pixel in a present frame;

compensating the first present sub-image data based on a result of comparison with a first reference value and a differential value between the first sub-image data and the first previous sub-image data to generate first compensated sub-image data;

compensating the second present sub-image data based on a result of comparison with a second reference value and a differential value between the second sub-image data and the second previous sub-image data to generate second compensated sub-image data;

outputting the first compensated sub-image data and the second compensated sub-image data; and controlling at least one of an output time of the first compensated sub-image data and an output time of the second compensated sub-image data, wherein the first reference value is higher than the second reference value.

17. The method of claim 16, further comprising storing the first previous sub-image data or the second previous sub-image data in at least one data memory.

18. The method of claim 16, wherein the first present sub-image data has a first gray scale, and the second present sub-image data has a second gray scale that is different from the first gray scale.

19. The method of claim 16, further comprising:

generating a first data voltage based on the first compensated sub-image data;

providing the first data voltage to the first sub-pixel;

generating a second data voltage based on the second compensated sub-image data; and providing the second data voltage to the second sub-pixel.

20. The method of claim 19, wherein the first data voltage is different from the second data voltage.

21. The method of claim 19, wherein the first sub-pixel has a different gamma curve from the second sub-pixel.

* * * * *